US008231698B2

(12) United States Patent
De Leeuw-Morrison et al.

(10) Patent No.: US 8,231,698 B2
(45) Date of Patent: Jul. 31, 2012

(54) POLYCRYSTALLINE DIAMOND ABRASIVE COMPACTS

(76) Inventors: Barbara Mariëlle De Leeuw-Morrison, Johannesburg (ZA); Cornelis Roelof Jonker, Pretoria (ZA); Roger William Nigel Nilen, Dowerglen (ZA)

( * ) Notice: Subject to any disclaimer, the term of this patent is extended or adjusted under 35 U.S.C. 154(b) by 231 days.

(21) Appl. No.: 12/447,755

(22) PCT Filed: Oct. 31, 2007

(86) PCT No.: PCT/IB2007/054409

§ 371 (c)(1),
(2), (4) Date: Jun. 30, 2009

(87) PCT Pub. No.: WO2008/053430

PCT Pub. Date: May 8, 2008

(65) Prior Publication Data

US 2010/0064595 A1 Mar. 18, 2010

(30) Foreign Application Priority Data

Oct. 31, 2006 (ZA) ..... 2006/09072

(51) Int. Cl.
*B24D 3/00* (2006.01)
*C09D 1/00* (2006.01)

(52) U.S. Cl. ..... 51/309; 51/307; 51/293

(58) Field of Classification Search ..... 51/293, 51/307, 309

See application file for complete search history.

(56) References Cited

U.S. PATENT DOCUMENTS

| | | | | |
|---|---|---|---|---|
| 3,743,489 | A | 7/1973 | Wentorf, Jr. et al. | |
| 3,745,623 | A | 7/1973 | Wentorf, Jr. et al. | |
| 3,767,371 | A | 10/1973 | Wentorf, Jr. et al. | |
| 4,231,762 | A | 11/1980 | Hara et al. | |
| 4,505,746 | A | 3/1985 | Nakai et al. | |
| 6,869,460 | B1 | 3/2005 | Bennett et al. | |
| 2005/0061105 | A1 * | 3/2005 | Bennett et al. | 75/236 |
| 2005/0230156 | A1 * | 10/2005 | Belnap et al. | 175/375 |

FOREIGN PATENT DOCUMENTS

| | | | |
|---|---|---|---|
| EP | 0 174 546 | A | 3/1985 |
| EP | 0 223 585 | A | 5/1987 |

* cited by examiner

*Primary Examiner* — Elizabeth Wood

(74) *Attorney, Agent, or Firm* — Frommer Lawrence & Haug LLP; Ronald R. Santucci

(57) ABSTRACT

The invention is for a polycrystalline diamond abrasive compact comprising a layer of polycrystalline diamond bonded to a cemented tungsten carbide substrate. The polycrystalline diamond defines a plurality of interstices and a binder phase is distributed in the interstices to form binder pools. The polycrystalline diamond is characterized by the presence of a separate tungsten particulate phase in the binder phase, in excess of 0.05 volume % but not greater than 2 volume %, expressed as a % of the total polycrystalline diamond, and the binder phase further containing a low eta-phase, Co3W3C, content as determined by conventional XRD analysis, an XRD peak height of the <511> eta-phase (Co3W3C) peak which is less than 0.06 when expressed as a fraction of the peak height of the <200> cubic cobalt peak. The invention extends to a composition and to a method for manufacturing the polycrystalline diamond abrasive compact.

15 Claims, No Drawings

POLYCRYSTALLINE DIAMOND ABRASIVE COMPACTS

This application is a 371 of PCT/IB2007/054409 filed on Oct. 31, 2007, published on May 8, 2008 under publication number WO 2008/053430 A and claims priority benefits of South African Patent Application No. 2006/09072 filed Oct. 31, 2006, the disclosure of which is incorporated herein by reference.

BACKGROUND OF THE INVENTION

The invention relates to polycrystalline diamond abrasive compacts and a method of producing polycrystalline diamond abrasive compacts.

Polycrystalline diamond abrasive compacts (PDC) are used extensively in cutting, milling, grinding, drilling and other abrasive operations due to the high abrasion resistance of the polycrystalline diamond component. In particular, they find use as shear cutting elements included in drilling bits used for subterranean drilling. A commonly used PDC is one that comprises a layer of coherently bonded diamond particles or polycrystalline diamond (PCD) bonded to a substrate. The diamond particle content of these layers is typically high and there is generally an extensive amount of direct diamond-to-diamond bonding or contact. Diamond compacts are generally sintered under elevated temperature and pressure conditions at which the diamond particles are crystallographically or thermodynamically stable.

Examples of composite abrasive compacts can be found described in U.S. Pat. Nos. 3,745,623; 3,767,371 and 3,743,489.

The PCD layer tends to be relatively brittle and this often limits the lifespan of the tool in application. Hence the PCD layer is generally bonded to a metal backing material, serving as a hard-wearing support for the diamond composite portion. By far the most common form of the resultant body is a disc of polycrystalline diamond bonded to a cylinder of cemented carbide such as WC—Co. Bonding of these two elements is usually achieved in-situ during the sintering of the diamond powder precursor at high pressure and temperature (HpHT).

The PCD layer of this type of abrasive compact will typically contain a catalyst/solvent or binder phase in addition to the diamond particles. This typically takes the form of a metal binder matrix which is intermingled with the intergrown network of particulate diamond material. This matrix usually comprises a metal exhibiting catalytic or solvating activity towards carbon such as cobalt, nickel, iron or an alloy containing one or more such metals.

The matrix or binder phase may also contain additional phases. In typical abrasive compacts of the type of this invention, these will constitute less than 10 mass % of the final binder phase. These may take the form of additional separate phases such as metal carbides which are then embedded in the softer metallic matrix, or they may take the form of elements in alloyed form within the dominant metal phase Composite abrasive compacts are generally produced by placing the components necessary to form an abrasive compact, in particulate form, on a cemented carbide substrate. The components may, in addition to ultrahard particles, comprise solvent/catalyst powder, sintering or binder aid material. This unbonded assembly is placed in a reaction capsule which is then placed in the reaction zone of a conventional high pressure/high temperature apparatus. The contents of the reaction capsule are then subjected to suitable conditions of elevated temperature and pressure to enable sintering of the overall structure to occur.

It is common practice to rely at least partially on binder originating from the cemented carbide as a source of metallic binder material for the sintered polycrystalline diamond. (In many cases however, additional metal binder powder is admixed with the diamond powder before sintering.) This binder phase metal then functions as the liquid-phase medium for promoting the sintering of the diamond portion under the imposed sintering conditions.

Under typical high pressure, high temperature sintering conditions, binder metal phase originating from the cemented carbide substrate will also carry with it appreciable levels of dissolved species originating from the carbide layer, as it infiltrates the diamond layer. The amount of dissolved species is strongly affected by the pressure and temperature conditions of sintering—where higher temperatures will typically increase the amount in solution. When the preferred substrate of WC—Co is used, these are W-based species.

As it infiltrates into the PCD region, this dissolved tungsten reacts with solvent metal and carbon from the diamond layer, and may precipitate out carbide-based phases. In some cases, depending on the nature of the metallurgy of the binder phase, so-called eta phase will also form.

Eta-phase is well-known in the general carbide industry; and is taken to mean compositions of W, C and solvent metal, M (in this case, cobalt) such as $W_xM_yC$ etc. One of these, an intermetallic carbide, specifically $Co_3W_3C$, remains in the final ultrahard compact if it forms. This phase is known to be brittle and can provide sites for crack initiation and propagation in the final composite structure. Its presence can hence result in a deterioration in composite properties.

The prior art for carbide manufacture contains several references to methods for controlling and/or manipulating the formation of eta-phase in conventional carbide materials. For example, U.S. Pat Application 2005/0061105, which issued as U.S. Pat. No. 6,869,460, discusses a method for achieving an eta-phase free carbide composite by manipulating the binder concentration in the material.

Eta-phase, $Co_3W_3C$, will typically be present in polycrystalline diamond abrasive compacts where significant amounts of dissolved W have been carried up from the substrate on infiltration. They hence occur in conjunction with the formation of other precipitating W-based phases such as WC in the PCD layer. Eta-phase appears to be particularly observed where relatively higher sintering temperatures have been utilised to improve diamond-to-diamond sinter quality. At lower sintering temperatures, eta-phase can be reduced; however, reducing sinter temperature is not practicable as this will typically result in sub-optimal sintering conditions and hence a less desirable PCD.

The development of an abrasive compact that can achieve optimal properties of impact and wear resistance in the PCD layer is highly desirable. The difficulty lies in that these optimal properties typically occur in a similar sintering environment to that where carbide-based defect phases in the PCD layer can arise. These defect phases themselves have a highly detrimental effect on these same required properties. Hence a means of preventing or inhibiting their formation is highly desirable.

SUMMARY OF THE INVENTION

According to a first aspect of the invention, there is provided a polycrystalline diamond abrasive compact comprising a layer of polycrystalline diamond bonded to a cemented tungsten carbide substrate, the polycrystalline diamond defining a plurality of interstices and a binder phase being distributed in the interstices to form binder pools, the polycrystalline diamond being characterised by the presence of a separate tungsten particulate phase in the binder phase, in excess of 0.05 volume %, but not greater than 2 volume %, preferably not more than 1.5 volume %, expressed as a % of the total polycrystalline diamond, and the binder phase further containing a low eta-phase, $Co_3W_3C$, content as determined by conventional XRD analysis, an XRD peak height of the <511> eta-phase ($Co_3W_3C$) peak (after background correction) which is less than 0.06, more preferably less than 0.05 and most preferably less than 0.04; when expressed as a fraction of the peak height of the <200> cubic cobalt peak.

The polycrystalline diamond abrasive compact may be produced by placing a powdered diamond composition on a surface of a cemented tungsten carbide substrate to form an unbonded assembly and then subjecting the unbonded assembly to conditions of temperature suitable to form polycrystalline diamond from the composition. The composition preferably comprises a mixture of diamond particles, binder in particulate form and finely particulate tungsten carbide particles present in an amount of 0.5 to 5 mass %, preferably 1.0 to 3.0 mass %, of the composition. Such a powdered composition forms another aspect of the invention. The size of the tungsten carbide particles is preferably less than 1 micron and more preferably less than 0.75 microns.

The invention extends to the use of the polycrystalline diamond abrasive compacts of the invention as abrasive cutting elements, for example for cutting or abrading of a substrate or in drilling applications.

DESCRIPTION OF EMBODIMENTS

The present invention is directed to polycrystalline diamond abrasive compacts made under high pressure/high temperature conditions. These abrasive compacts are characterised by the polycrystalline diamond layer having a binder phase of such metallurgical nature that, although W-based phases are easily discernible by microstructural analysis, none of these manifest as eta-phase, $Co_3W_3C$, as determined by XRD analysis.

The diamond particles may be natural or synthetic in origin. The average grain size of the diamond particles is typically in the range between submicron and tens of microns in size. This invention has particular application where the average diamond grain size is less than 25 μm, more preferably less than about 20 μm and most preferably less than 15 μm.

To produce a polycrystalline diamond compact a powdered diamond composition, as described above, on a surface of a cemented tungsten carbide substrate will be subjected to known temperature and pressure conditions necessary to produce an abrasive compact. These conditions are typically those required to synthesize the abrasive particles themselves. Generally, the pressures used will be in the range 40 to 70 kilobars and the temperature used will be in the range 1300° C. to 1600° C.

The binder metal for the cemented tungsten carbide may be any known in the art such as nickel, cobalt, iron or an alloy containing one or more of these metals. Typically, this binder will be present in an amount of 10 to 20% by mass in the substrate body, but this may be as low as 6% by mass. Some of the binder metal will generally infiltrate the abrasive compact during compact formation.

The polycrystalline diamond of the invention has a binder phase present. This binder material is preferably a diamond catalyst/solvent. Catalyst/solvents for diamond are well known in the art. The binder is preferably cobalt, nickel, iron or an alloy containing one or more of these metals. This binder can be introduced either by infiltration into the mass of diamond particles during the sintering treatment, or in particulate form as a mixture within the mass of diamond particles. Infiltration may occur from either a supplied shim or layer of the binder interposed between the substrate and diamond layer, or from the carbide support. Typically a combination of approaches is used.

During the high pressure, high temperature treatment, the catalyst/solvent material melts and migrates through the diamond layer, acting as a catalyst/solvent and hence causing the diamond particles to bond to one another through the formation of reprecipitated diamond phase. Once manufactured, the PCD therefore comprises a coherent matrix of diamond particles bonded to one another, thereby forming a polycrystalline diamond composite material with many interstices containing binder as described above. In essence, the final polycrystalline diamond comprises a two-phase composite, where the diamond comprises one phase and the binder or solvent/catalyst the other.

The applicants have discovered that by introducing finely particulate tungsten carbide into the unsintered diamond mass as a dopant at fairly low mass levels prior to sintering, it is possible to inhibit the formation of particularly undesirable eta-phase within the binder during or after sintering. Without being bound by theory, it is possible that the doped powder mix behaves as a filter, deliberately drawing out any solute W in a controlled way, and so alters the kinetics of phase formation in the binder matrix.

The method for generating compacts of the invention is therefore typically characterized by the initial addition of finely particulate tungsten carbide to the unsintered diamond particle mixture that is used. This may take the form of admixed separate particles, or may be introduced by the erosive use of WC milling media during diamond powder mix preparation, where the abrasive action of the diamond particles on the WC milling balls results in the introduction of the desired levels under fairly strenuous milling conditions. Deposition through chemical or physical means may be used to introduce tungsten carbide into the diamond powder mixture. Sometimes a combination of these methods may be used.

Typically this addition will be in the range of about 0.5 mass % up to about 5 mass % expressed as a percentage of the unsintered diamond particle mixture. Levels of tungsten carbide introduced at 0.7 mass % will typically have positive effects. Typically, however, the more preferred range of addition is from 1.0 to 3 mass.

It is also preferred that the tungsten carbide particles are as fine as possible, such that each particle serves as an effective, yet stable, dopant centre without significantly interfering with the diamond sintering process. It is preferred that the average particle size of the WC introduced into the diamond mixture does not exceed 1 μm; and more preferably does not exceed 0.75 μm. It is anticipated that where the particles become too fine in size, the solubility of the WC phase in the molten catalyst/solvent may result in the complete dissolution of significant numbers of the particles. The doping effect would then be substantially compromised. Even in the preferred ranges of the invention, it is anticipated that some of the particles may partially dissolve, although this is mitigated by the fact that the molten catalyst/solvent solution is largely saturated with tungsten from the carbide substrate.

It is not necessarily required that the carbide particles be introduced throughout the PCD layer, as substantial benefits have also been recognised where only the PCD layer in the region immediately adjacent to the substrate interface has been doped with carbide particulates. Thus, in manufacturing this form of the invention, the diamond/tungsten carbide powdered composition will form a region immediately adjacent to the substrate interface and a layer of diamond, optionally with a binder phase in particulate form, will be placed on the powdered composition. In some cases where the PCD layer or table is particularly prone to eta-phase formation, however, it may be required that all, or the larger part, of the PCD mixture be doped. For ease of manufacture, it may also be preferred that the entire PCD layer is doped.

The polycrystalline diamond abrasive compact of this invention has a characteristic binder metallurgy, in that the presence of eta-phase (as measured using conventional XRD analysis) is reduced, whilst still exhibiting highly discernible levels of other W-based species. Compacts of this invention are therefore characterised by the polycrystalline diamond layers having an XRD peak height for the <511> $Co_3W_3C$ peak (at a nominal d-spacing of 2.13 Å) after background correction which has a relative peak intensity ($I_{eta}$:$I_{Co}$) of less than 0.06, more preferably less than 0.05 and most preferably less than 0.04. The relative peak intensity ($I_{eta}$:$I_{Co}$) is measured relative to the cubic cobalt <200> peak at a nominal d-spacing value of 1.7723 Å using conventional XRD methodology.

The measurement of the W-phase volume % is carried out on the final composite focussing on the PCD layer, by conducting a statistical evaluation of a large number of collected images taken on a scanning electron microscope. The W-phase grains in the final microstructure, which are easily distinguishable from the remainder of the microstructure using electron microscopy, are isolated in these images using conventional image analysis technology. The overall area occupied by W-phase is measured; and this area % is taken to be equivalent to the overall volume % of W-phase(s) present in the microstructure. Typically magnification levels of 1000 times to 2000 times are chosen to characteristically represent PCD structures of interest in this invention, where the average diamond grain size is submicron up to tens of micron in size.

The average value for the volume % of WC present in the compacts of this invention is decided by the combination of the WC introduced into the diamond powder mixture as dopant; and the WC originating from the substrate which precipitates near or onto these dopant particles. In prior art compacts, two distinct populations of WC content are typically observable. There are those with little appreciable overall WC content i.e. where the WC content lies below 0.05 volume % or certainly significantly below 0.1 volume %; and those with a WC volume % in excess of this threshold. Typically those with reduced overall WC carbide content will not be optimally sintered; whilst it is those with WC contents in excess of 0.1 volume % that suffer from the carbide phase defect formation previously discussed. Compacts of this invention will typically have WC levels in excess of 0.05 volume %, and more typically WC levels not less than 0.1 volume %.

The invention will now be illustrated by the following non-limiting examples:

EXAMPLE 1

Example 1A

WC Introduced by Admilling

A multimodal diamond powder with an average grain size of approximately 15 μm was milled under typical diamond powder mix preparation conditions in a planetary ball mill, together with 1% by mass cobalt powder using WC milling balls. The milling conditions were monitored so as to maximise the erosion of the WC milling media allowing the addition of WC to the mixture at an overall level of 0.7 mass % in the final diamond mixture. The size of the WC fragment introduced in this manner was typically less than 0.5 μm. This powder mixture was sintered onto a standard cemented WC substrate under typical pressure and temperature conditions in order to produce a polycrystalline diamond layer well bonded to the substrate. The resultant sample is designated Sample 1A in Table 1 below.

Example 1B

WC Introduced by Admixing

A multimodal diamond powder with an average grain size of approximately 15 μm was prepared under typical diamond powder mix preparation conditions in a high shear mixer, together with 1% by mass cobalt powder in the absence of any WC milling media. Particulate WC powder was added to achieve a level of 0.7 mass % in the final diamond mixture. The size of the WC fragment introduced was typically between 0.35 and 0.7 μm. This powder mixture was sintered onto a standard cemented WC substrate under typical pressure and temperature conditions in order to produce a polycrystalline diamond layer bonded to the substrate. The resultant sample is designated Sample 1B in Table 1 below.

Example 1C

Comparative Sample Produced by Admixing

A multimodal diamond powder with an average grain size of approximately 15 μm was prepared under typical diamond powder mix preparation conditions in a high shear mixer, together with 1% by mass cobalt powder in the absence of any WC milling media. This powder mixture was sintered onto a standard cemented WC substrate under typical pressure and temperature conditions in order to produce a polycrystalline diamond layer bonded to the substrate. The resultant sample is designated Sample 1C in Table 1 below.

The samples A to C were all subjected to an analysis as described above to determine the WC eta phase content in the polycrystalline diamond layer of each sample. The results are set out in Table 1.

TABLE 1

| | Mix preparation details | | | Final microstructure: WC character | |
|---|---|---|---|---|---|
| ID | Description | Amount WC | Average WC size | Volume % | Eta phase $I_{eta}$:$I_{Co}$ |
| 1A | WC (admilled) | 0.7 | <0.5 μm | 0.16 | 0.020 |
| 1B | WC (admixed) | 0.7 | 0.35-0.7 μm | 0.31 | 0.018 |
| 1C | Undoped | 0.0 | — | 0.26 | 0.114 |

It will be noted from the above Table that the WC eta phase present in Samples A and B, according to the invention, is far less than that of Sample C, where there was no doping with finely particulate tungsten carbide.

The invention claimed is:

1. A polycrystalline diamond abrasive compact comprising a layer of polycrystalline diamond bonded to a cemented tungsten carbide substrate, the polycrystalline diamond comprising a coherent matrix of diamond particles bonded to one another and defining a plurality of interstices and a binder phase being distributed in the interstices to form binder pools, the polycrystalline diamond being characterised by the presence of a separate tungsten particulate phase in the binder phase, the tungsten particulate phase being present in an amount in excess of 0.05 volume % but not greater than 1.5 volume %, expressed as a % of the total polycrystalline diamond, and the binder phase further containing a low eta-phase, $Co_3W_3C$, content as determined by conventional XRD analysis, an XRD peak height of the <511> eta-phase ($Co_3W_3C$) peak (after background correction) which is less than 0.06 when expressed as a fraction of the peak height of the <200> cubic cobalt peak.

2. A polycrystalline diamond abrasive compact according to claim 1, in which the XRD peak height of the <511> eta-phase (Co3W3C) peak (after background correction) is less than 0.05 when expressed as a fraction of the peak height of the <200> cubic cobalt peak.

3. A polycrystalline diamond abrasive compact according to claim 1, in which the XRD peak height of the <511> eta-phase ($Co_3W_3C$) peak (after background correction) is less than 0.04 when expressed as a fraction of the peak height of the <200> cubic cobalt peak.

4. A polycrystalline diamond abrasive compact according to claim 1, in which the diamond particles have a diamond grain size of between 1 micron and up to an average diamond grain size of less than 25 microns.

5. A polycrystalline diamond abrasive compact according to claim 1, in which the diamond particles have an average diamond grain size less than 20 microns.

6. A polycrystalline diamond abrasive compact according to claim 1, in which the diamond particles have an average diamond grain size less than 15 microns.

7. A polycrystalline diamond abrasive compact according to claim 1, in which the binder phase includes a diamond catalyst/solvent.

8. A polycrystalline diamond abrasive compact according to claim 1, in which the binder phase includes cobalt, nickel, iron or an alloy containing one or more of these metals.

9. A method of manufacturing a polycrystalline diamond abrasive compact according to claim 1, comprising placing a composition including a mixture of diamond particles, binder in particulate form and finely particulate tungsten carbide particles present in an amount of 0.5 to 5 mass % of the composition on a surface of a cemented tungsten carbide substrate and subjecting to temperature and pressure conditions necessary to produce an abrasive compact.

10. A method according to claim 9, in which the tungsten carbide particles are present in an amount of 1.0 to 3.0 mass % of the composition.

11. A method according to claim 9, in which the size of the tungsten carbide particles is less than 1 micron.

12. A method according to claim 9, in which the size of the tungsten carbide particles is less than 0.75 microns.

13. A method according to claim 9, in which the composition forms a region adjacent the surface of the substrate on which it is placed and a layer of diamond particles is placed on the composition.

14. A polycrystalline diamond abrasive compact according to claim 1, in which the tungsten particulate phase is present in an amount of about 0.16 to 0.31 volume %, and the XRD peak height of the <511> eta-phase ($Co_3W_3C$) peak (after background correction) is about 0.018 to about 0.020 when expressed as a fraction of the peak height of the <200> cubic cobalt peak.

15. A method according to claim 9 in which the tungsten particulate phase is present in an amount of about 0.16 to 0.31 volume %, and the XRD peak height of the <511> eta-phase ($Co_3W_3C$) peak (after background correction) is about 0.018 to about 0.020 when expressed as a fraction of the peak height of the <200> cubic cobalt peak.

* * * * *